US005120292A

United States Patent [19]

Ueda et al.

[11] Patent Number: 5,120,292

[45] Date of Patent: Jun. 9, 1992

[54] APPARATUS FOR FORMING CONTAINERS

[75] Inventors: Kazuo Ueda; Takeo Ogura; Takehiko Aihara, all of Tokushima, Japan

[73] Assignee: Shikoku Kakoki Co., Ltd., Tokushima, Japan

[21] Appl. No.: 580,676

[22] Filed: Sep. 11, 1990

[30] Foreign Application Priority Data

Sep. 13, 1989 [JP] Japan ..... 1-238263

[51] Int. Cl.[5] ..... B31B 3/32

[52] U.S. Cl. ..... 493/124; 492/134; 492/164

[58] Field of Search ..... 493/122, 123, 124, 125, 493/126, 133, 134, 164, 175, 176, 183, 295

[56] References Cited

U.S. PATENT DOCUMENTS

| | | | |
|---|---|---|---|
| 3,018,702 | 1/1962 | Bauder | 493/164 |
| 3,225,666 | 12/1965 | Reimers | 493/164 |
| 3,303,761 | 2/1967 | Monroe et al. | 493/164 |
| 3,566,762 | 3/1971 | Vadas et al. | 493/164 |
| 3,788,033 | 1/1974 | Martensson et al. | 493/133 |
| 3,978,639 | 9/1976 | Ferozi | 493/164 |
| 3,999,469 | 12/1976 | Nilsson | 493/164 |
| 4,776,830 | 10/1988 | Fujikawa et al. | 493/183 |

*Primary Examiner*—William E. Terrell

*Attorney, Agent, or Firm*—Armstrong, Nikaido, Marmelstein, Kubovcik & Murray

[57] ABSTRACT

An apparatus is disclosed for forming planar sheets into containers for containing a flowable food or like product. The container-forming apparatus has an apparatus frame with a plurality of treating stations including a planar sheet feed station. The apparatus also has a rotary body having radial mandrels which are rotatable so as to stop at each of the plurality of treating stations. A holding device is provided on each of the mandrels for holding the planar sheets to the mandrel, and a feeder, preferably having suction cups, is provided for feeding the planar sheet to the holding device at the sheet feed station. The various treating stations along the path of movement of the mandrels are for forming the sheet into a tube and closing one end of the tube to form a bottom of the container.

11 Claims, 13 Drawing Sheets

APPARATUS FOR FORMING CONTAINERS

BACKGROUND OF THE INVENTION

The present invention relates to an apparatus for forming blanks into containers for containing a flowable food or like product.

Such apparatus heretofore known comprise a rotary body having radial mandrels, and a group of devices for forming tubular containers having a bottom from blanks folded flat so as to be unfolded to a tubular form by feeding to the mandrels the blanks as unfolded to the tubular form, and folding and pressing one end of each tubular blank to close the end and form the bottom.

The blanks to be handled by the apparatus described are folded flat so as to be unfolded into tubes. Such blanks are prepared, for example, by a paper manufacturer who makes the paper material for the blank and are supplied to a food dealer who employs the container forming apparatus. The blanks to be supplied to the food dealer are more costly than before they are folded flat so as to be unfoldable to a tubular form, for example, than planar blanks. Accordingly, these blanks have the problem of increasing the running cost of the container forming apparatus.

SUMMARY OF THE INVENTION

The main object of the present invention is to provide a container forming apparatus which is reduced in running cost.

The present invention provides a container forming apparatus which comprises an apparatus frame having a plurality of treating stations including a blank feed station, a rotary body having radial mandrels and intermittently drivingly rotatable so as to stop each of the mandrels at the plurality of treating stations successively, holding means provided on each of the mandrels for holding a planar blank to the mandrel fittably therearound, a feeder for feeding the planar blank to the holding means at the blank feed station, and a series of devices arranged one after another along the path of movement of the mandrels extending from the blank feed station for forming the blank held by the holding means into a tube as fitted around the mandrel and closing one end of the tubular blank to form a container having a square to rectangular cross section and a bottom at the closed end.

The apparatus of the present invention forms tubular containers with a bottom from planar blanks which are less expensive than blanks which are folded flat so as to be unfoldable to a tubular form. Accordingly, the container forming apparatus is reduced in running cost.

BRIEF DESCRIPTION OF THE DRAWINGS

FIG. 1 is a perspective view;

FIG. 2 is a side elevation;

FIGS. 3 to 5 are views of the embodiment as it is seen in the directions of arrows III—III, IV—IV and V—V, respectively, of FIG. 2;

FIG. 6 is a diagram showing a process for forming a first blank into a container;

FIG. 7 is a diagram showing a process for forming a second blank into a container;

FIG. 8 is a development of the first blank;

FIG. 9 is a development of the second blank;

FIG. 10 is a side elevation corresponding to FIG. 2;

FIGS. 11 to 13 are views of the embodiment as it is seen in the directions of arrows XI—XI, XII—XII and XIII—XIII, respectively, of FIG. 10;

FIG. 14 is a diagram showing a process for forming a third blank into a container;

FIG. 15 is a diagram showing a process for forming a fourth blank into a container;

FIG. 16 is a development of the third blank; and

FIG. 17 is a development of the fourth blank.

DESCRIPTION OF THE PREFERRED EMBODIMENTS

Embodiments of the present invention will be described with reference to the drawings.

FIRST EMBODIMENT

FIGS. 1 to 9 show a first embodiment.

Figure 8:
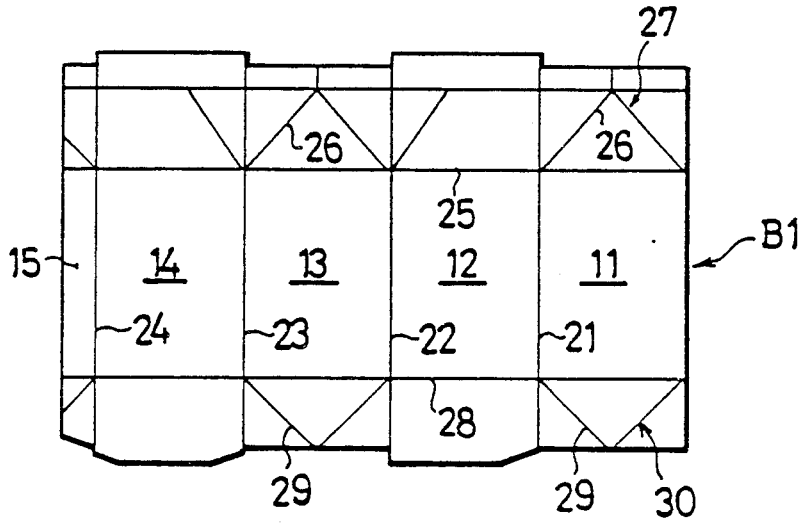
Figure 9:
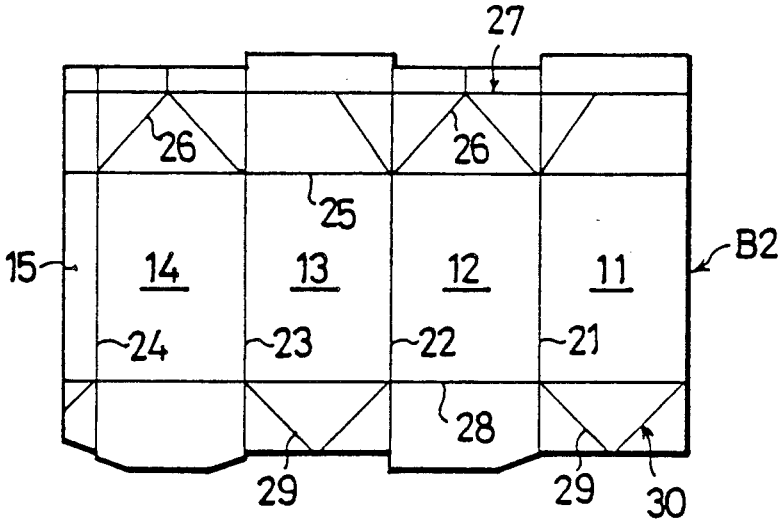

In this embodiment, two kinds of blanks, i.e., first blanks B1 and second blanks B2 as shown in FIGS. 8 and 9, respectively, are used. Each of these drawings shows the side of the blank providing the outer surface of the container to be formed. The blanks to be described below are each made of a paper-base laminate having a thermoplastic synthetic resin layer over each of the outer and inner surfaces.

With reference to FIG. 8, the first blank B1 comprises rectangular first to fourth panels 11 to 14 of the same size extending continuously as arranged successively from the right leftward and partitioned by four vertical scores 21 to 24, and a seam-forming elongated fifth panel 15 continuous with the left edge of the fourth panel 14.

The upper portions of the first to fifth panels 11 to 15 have an upper horizontal score 25 intersecting the vertical scores 21 to 24, and top-forming scores 27 extending upward from the horizontal score 25, including inverted V-scores 26 and formed in a required pattern for folding the upper portions in the form of a gabled roof. The lower portions of the first to fifth panels 11 to 15 have a lower horizontal score 28 intersecting the vertical scores 21 to 24, and bottom-forming scores 30 extending downward from the score 28, including V-scores 29 and formed in a required pattern for folding the lower portions flat. The ridge L of the gabled roof of the container prepared from the first blank B1 is parallel to the trunk portions of the second panel 12 and the fourth panel 14 when seen from above (see FIG. 6).

With reference to FIG. 9, the second blank B2 closely resembles the first blank B1 but differs therefrom only in respect of the following. The upper portions of first to fifth panels 11 to 15 of the second blank B2 also have scores 27 formed in a required pattern for folding the upper portions into a gabled roof, the pattern being such that the top-forming scores 27 in the first and second panels 11, 12 of the first blank B1 are replaced by each other, with the scores 27 in the third and fourth panels 13, 14 of the blank B1 also replaced by each other. Thus, the inverted V-scores 26 are formed in the second and fourth panels 12, 14 of the second blank B2. Accordingly, the ridge L of the gabled roof of the container prepared from the second blank B2 is parallel to the trunk portions of the first panel 11 and the third panel 13 when seen from above (see FIG. 7).

The container forming apparatus as the first embodiment will be described below primarily with reference to a case wherein first blanks B1 are used.

Figure 1:
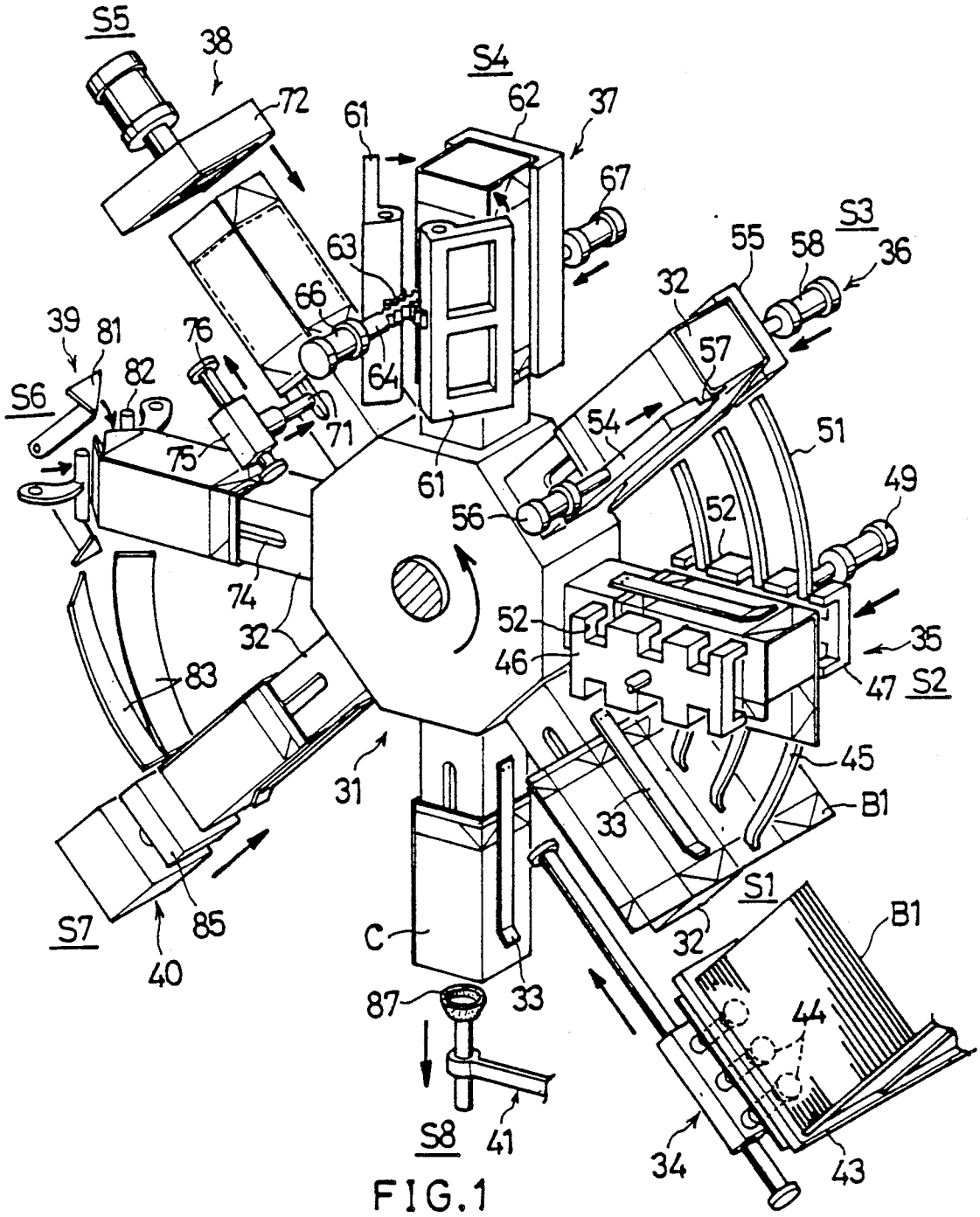
FIGS. 1 to 9 show a first embodiment.
Figure 2:
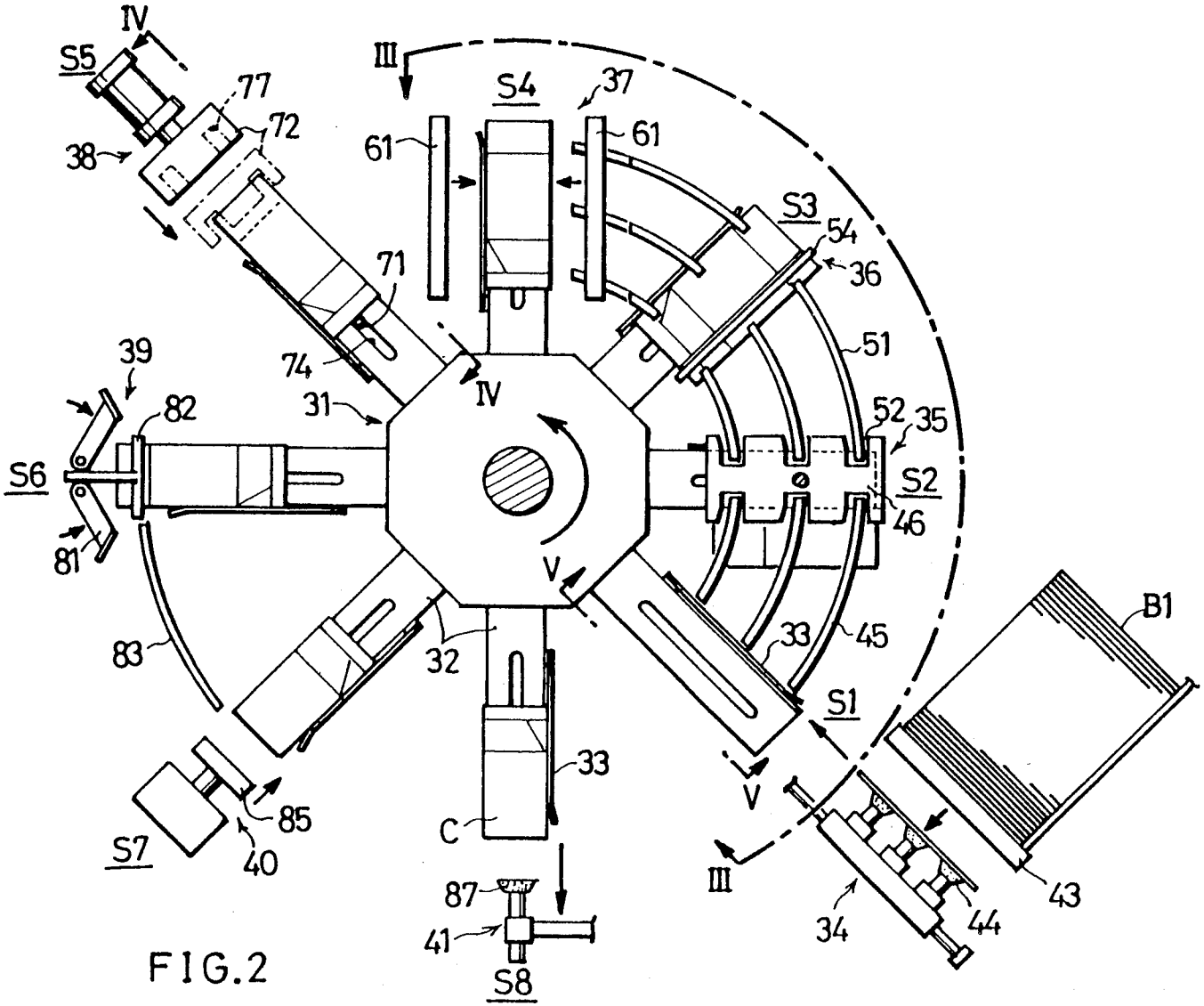

As mainly shown in FIGS. 1 and 2, the apparatus comprises an intermittently driven rotary body 31 having eight radial mandrels 32 and disposed above the starting end of a path of transport provided by an unillustrated container conveyor. With reference to FIG. 2, the rotary body 31 rotates counterclockwise so as to stop each of the mandrels 32 at first to eighth treating stations S1 to S8, the eighth treating station S8 being such that the mandrel 32 stops at this position as directed vertically downward.

In the following description, the term "front" refers to the direction in which the mandrel 32 advances, and the term "rear" to the opposite direction. The terms "right" and "left" are used as the mandrel 32 is viewed toward the front.

The mandrel 32 has four side faces, and a blank holder 33 made of a striplike plate spring is fitted over one of the four side faces which faces forward toward the direction of movement of the mandrel 32. The holder is fixed at its inner end to the mandrel side face.

A blank feeder 34 is disposed at the first treating station S1, a blank folder 35 along the path of movement of the mandrel from the station S1 to the second treating station S2, a seam heater 36 at the third treating station S3, a seam heater 37 at the fourth treating station S4, a bottom heater 38 at the fifth treating station S5, a bottom breaker 39 at the sixth treating station S6, a bottom sealer 40 at the seventh treating station S7, and a container transfer device 41 at the eighth treating station S8.

The blank feeder 34 comprises a magazine 43 disposed obliquely above and at a specified distance from an extension of the axis of the mandrel 32 stopped at the first treating station S1 for containing a multiplicity of planar blanks B1 as stacked up, and a suction member 44 movable in directions parallel and perpendicular to the extension of the axis of the mandrel 32 for withdrawing the blanks B1 one by one and feeding each blank to the mandrel 32 stopped at the first station S1.

The suction member 44 withdraws the blanks B1 one by one from the lowermost position within the magazine 43 and feeds the withdrawn blank B1 to the mandrel 32 so that the blank B1 is held between the mandrel 32 and the blank holder 33 with the third panel 13 thereof fitting to the forwardly directed side face of the mandrel 32.

Figure 3:
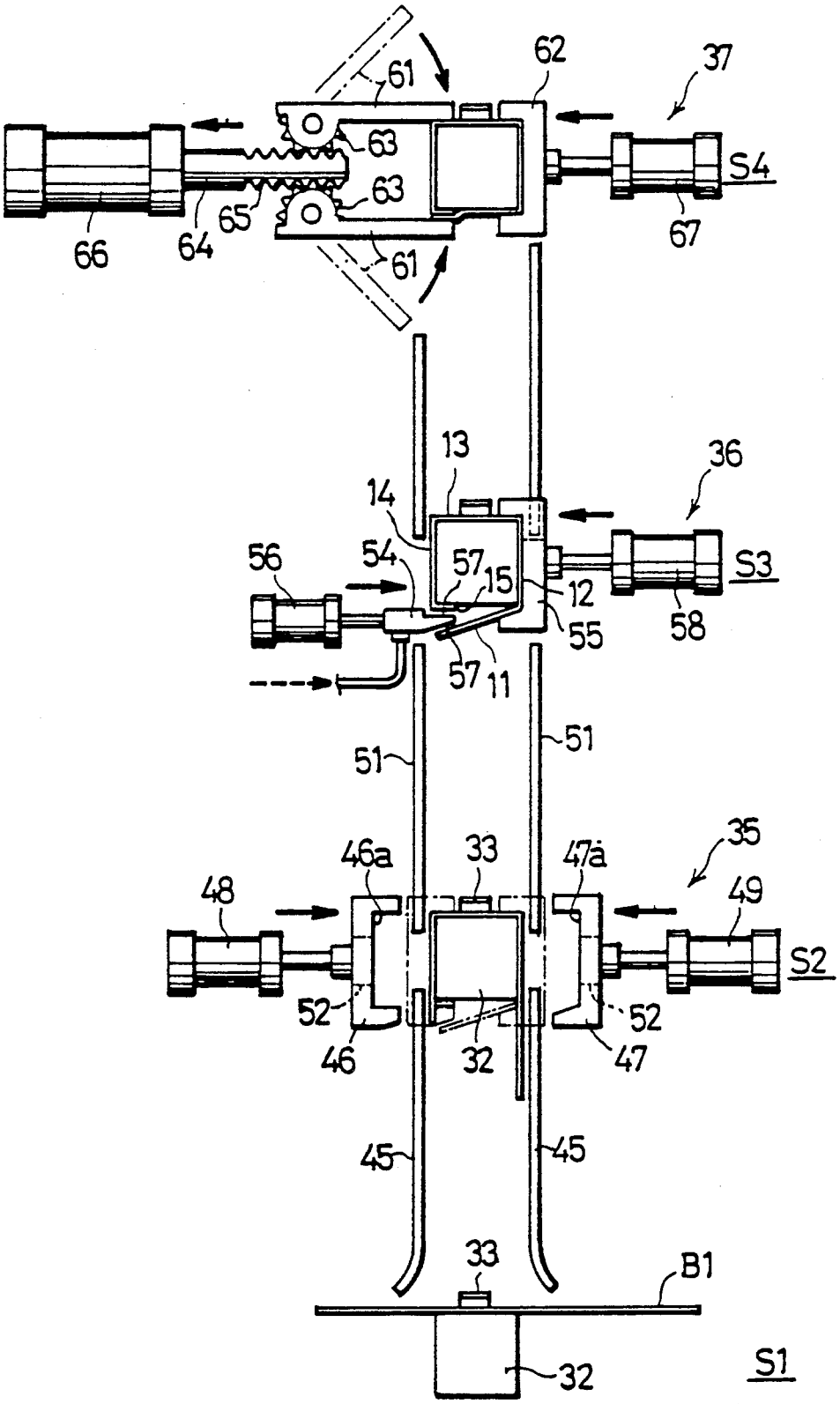

As shown in greater detail in FIG. 3, the blank folder 35 comprises three pairs of circular-arc folding rails 45 disposed at opposite sides of the path of movement of the mandrel and extending along the path from the first station S1 to the second station S2, the rails 45 of each pair being opposed to each other, and two folding members 46, 47 movable toward or away from each other and arranged at opposite sides of the mandrel 32 stopped at the second station S2 with the mandrel 32 positioned therebetween. The spacing between the folding rails 45 of each pair is slightly larger than a distance equal to the lateral width of the mandrel 32 plus two times the thickness of the blank B1. The two folding members 46, 47 are channel-shaped and slightly larger than the first to fourth panels 11 to 14 in length and width and have recesses 46*a*, 47*a*, respectively, which are fittable from outside to the blank B1 as fitted around the mandrel 32. The folding members 46, 47 are connected to the piston rods of hydraulic cylinders 48, 49, respectively, which are arranged outwardly thereof so as to oppose the openings of the recesses 46*a*, 47*a* to each other. Of the two folding members 46, 47, the right member 47 has a downwardly outwardly slanting lower inner face defining the recess 47*a*. The folding members 46, 47 are formed with cutouts 52 at suitable portions to avoid interference with the folding rails 45 and guides 51 disposed along the path subsequently.

Figure 5:
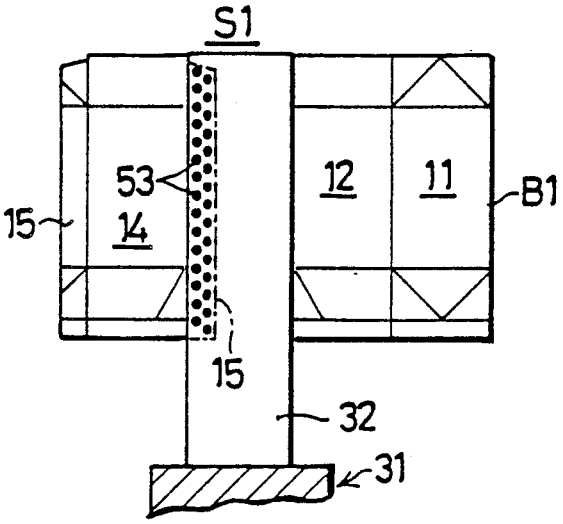

While the blank B1 held to the mandrel 32 moves from the first station S1 to the second station S2 along with the mandrel to pass between the pairs of folding rails 45, the folding rails 45 fold the blank B1 along the vertical score 22 at the boundary between the second panel 12 and the third panel 13 and along the vertical score 23 at the boundary between the third panel 13 and the fourth panel 14, fitting the second panel 12 over the right side face of the mandrel 32 and the fourth panel 14 over the left side face of the mandrel 32. When the blank B1 held to the mandrel 32 is brought to the second treating station S2, the two folding members 46, 47 move toward each other, pressing the blank B1 against the mandrel 32, whereby the blank B1 is folded along the vertical score 21 at the boundary between the first panel 11 and the second panel 12 and along the vertical score 24 at the boundary between the fourth panel 14 and the fifth panel 15. Consequently, the first panel 11 is made to face the rear side face of the mandrel 32 in a slanting state as spaced from the left edge of the rear side face without being fitted over the rear side face, whereas the fifth panel 15 is fitted to the rear side face of the mandrel 32. As seen in FIG. 5, the portion of the mandrel 32 over which the fifth panel 15 is fitted is dispersedly formed with a multiplicity of suction holes 53. The suction acting on the folded fifth panel 15 through the holes 53 holds the panel 15 fitted to the mandrel 32 without allowing the panel to revert to its original state owing to springback.

With reference also to FIG. 3, the seam heater 36 comprises a nozzle 54 so disposed as to be movable to or away from behind the mandrel 32 as stopped at the third treating station S3 for applying hot air to the inner surface of the free edge portion of the first panel 11 and to the outer surface of the fifth panel 15, and a holding member 55 movable toward or away from the mandrel 32 for holding the blank B1 to the mandrel before the application of hot air to prevent the blank B1 from shifting relative to the mandrel during the application. The nozzle 54 is in the form of a flat tube having a length larger than the height of the blank B1 and is attached to the piston rod of a hydraulic cylinder 56. A multiplicity of orifices 57 are formed in opposite walls of the nozzle tip. The holding member 55 resembles the right folding member 47 in shape and is similarly attached to the piston rod of a hydraulic cylinder 58.

When the blank B1 fitted around the mandrel 32 by being folded is brought to the third treating station S3, the holding member 55 first moves toward the mandrel 32 to press the blank B1 against the mandrel 32, whereby the blank B1 is brought to the same state as when folded by the folding members 46, 47. Subsequently, the nozzle 54 advances to position its tip between the free edge portion of the first panel 11 and the fifth panel 15. In this state, hot air is forced out from the orifices 57 to heat and melt the thermoplastic synthetic resin layer on the inner surface of free edge portion of the first panel 11 and the outer surface of the fifth panel 15.

As shown in detail also in FIG. 3, the seam sealer 37 comprises a pair of pivotally movable clamp members 61 for clamping from front and rear the blank B1 as fitted around the mandrel 32 stopped at the fourth treating station S4, and a holding member 62 for holding the blank B1 to the mandrel 32 before clamping to prevent displacement of the blank from the mandrel during the clamping. The clamp members 61 are each in the form of a rectangular frame having a length larger than the height of the blank B1. The clamp members 61 are each formed with a sector gear 63 at the base portion. The two sector gears 63 are in mesh with teeth 65 on the respective sides of a rack 64 which is integral with the piston rod of a hydraulic cylinder 66. The holding member 62 has the same shape as the left folding member 46 although oriented in opposite direction thereto, and is similarly attached to the piston rod of a hydraulic cylinder 67.

When the heated blank B1 is transported to the fourth treating station S4, the holding member 62 first moves toward the mandrel 32 to press the blank B1 against the mandrel 32, whereby the blank B1 is made to completely surround the mandrel 32, with the free edge portion of the first panel 11 fitted over the fifth panel 15. Subsequently, the clamp members 61 are moved toward each other to clamp the blank B1 as fitted around the mandrel 32. As a result, the free end portion of the first panel 11 is joined to the fifth panel 15.

Figure 4:
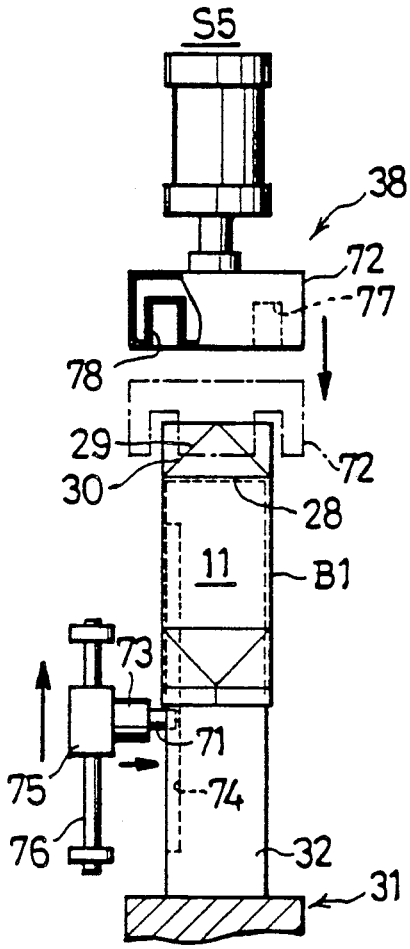

With reference to FIG. 4, the bottom heater 38 comprises a pushing-out member 71 for pushing out one end portion (outward portion beyond the lower horizontal score 28), to be made into a bottom, of the tubular blank B1 of square cross section beyond the mandrel, as the blank is fitted around the mandrel stopped at the fifth treating station S5, and a hot air blowing head 72 movable toward or away from the end portion for applying hot air to the end portion to be heated. The pushing-out member 71 is the piston rod of a thin cylinder 73. On the other hand, the mandrel 32 has a groove 74 formed in its left side face and extending axially thereof. The thin cylinder 73 is attached to the body of a rodless cylinder 75 to make the piston rod 71 movable along the groove 74. The rodless cylinder 75 is supported by a guide rail 76 extending in parallel to the axis of the mandrel 32 at the left side thereof. The head 72 has a cavity 77 for the end portion of the blank B1 to enter. The inner side surface defining the cavity 77 is formed with hot air orifices 78 in a pattern corresponding to the blank portion to be heated.

When the tubular blank B1 is transported to the fifth treating station S5, the blank B1 is first pushed out by the pushing-out member 71, whereby the bottom forming portion thereof is projected beyond the mandrel 32. At the same time or immediately thereafter, the hot air blowing head 72 moves toward the projected end, permitting the blank end to enter the cavity 77. In this state, hot air is forced out from the orifices 78 to heat and melt the thermoplastic synthetic resin layer of the blank B1 at the portion to be heated.

The bottom breaker 39, bottom sealer 40 and container transfer device 41 are all well known and therefore will be described briefly below.

The bottom breaker 39 comprises a pair of first folding members 81 openable along the direction of movement of the mandrel, a pair of second folding members 82 openable perpendicular to this direction, and circular-arc folding rails 83 extending from the sixth station S6 to the seventh station S7.

When the blank B1 heated at the bottom forming portion thereof is transported to the sixth station, the first folding members 81 are first closed, whereby of the two pairs of opposed quadrilateral parts providing the above portion, one pair of quadrilateral parts opposed to each other along the direction of movement of the mandrel 32 is closed inward between the other pair. The second folding members 82 are then closed, whereby the other pair of quadrilateral parts is folded inward over the quadrilateral parts folded by the first folding members 81. In this way, the portion to be made into the container bottom is made substantially flat. After having been thus folded, the blank B1 is then transported from the sixth station S6 to the seventh station S7 while the folded blank portion being pressed on to a flatter state by the folding rails 83.

The bottom sealer 40 has a press member 85 opposed to, and movable toward or away from, the forward end face of the mandrel 32 stopped at the seventh treating station S7.

When the blank B1 having the flat bottom forming portion is transported to the seventh station S7, the press member 85 moves toward the mandrel 32, pressing the folded end portion of the blank B1 against the mandrel end face, whereby the parts providing this portion are joined together to close the bottom of the blank B1 and provide a bottomed tubular container C.

The container transfer device 41 has an upwardly directed suction member 87 which is movable upward and downward and disposed below, and in alignment with, the mandrel 32 at a stop at the eighth treating station S8.

When the container C is transported to the eighth station S8, the suction member 87 holds the bottom of the container by suction and lowers, whereby the container C is transferred from the mandrel 32 to the container conveyor.

Figure 6:
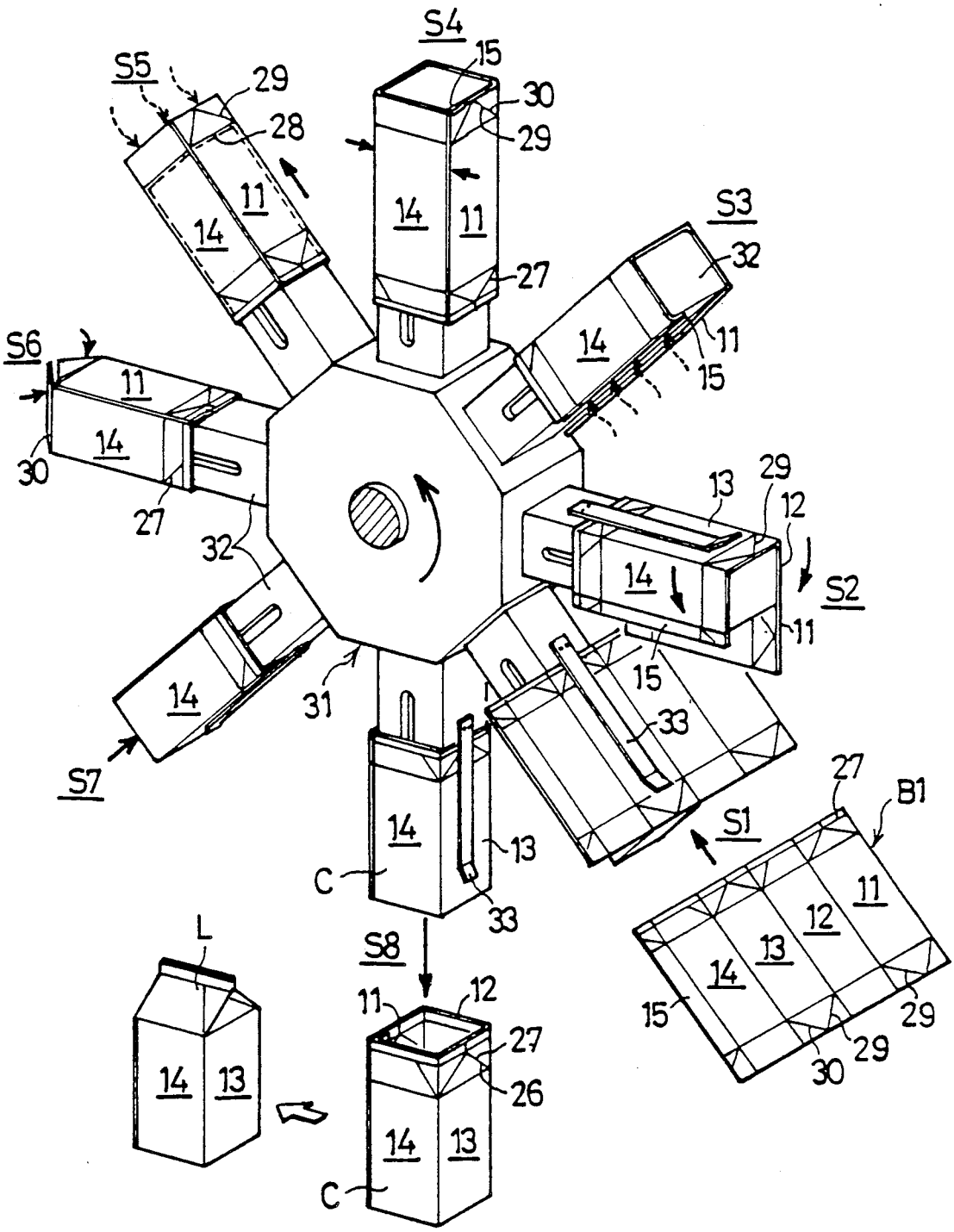
Figure 7:
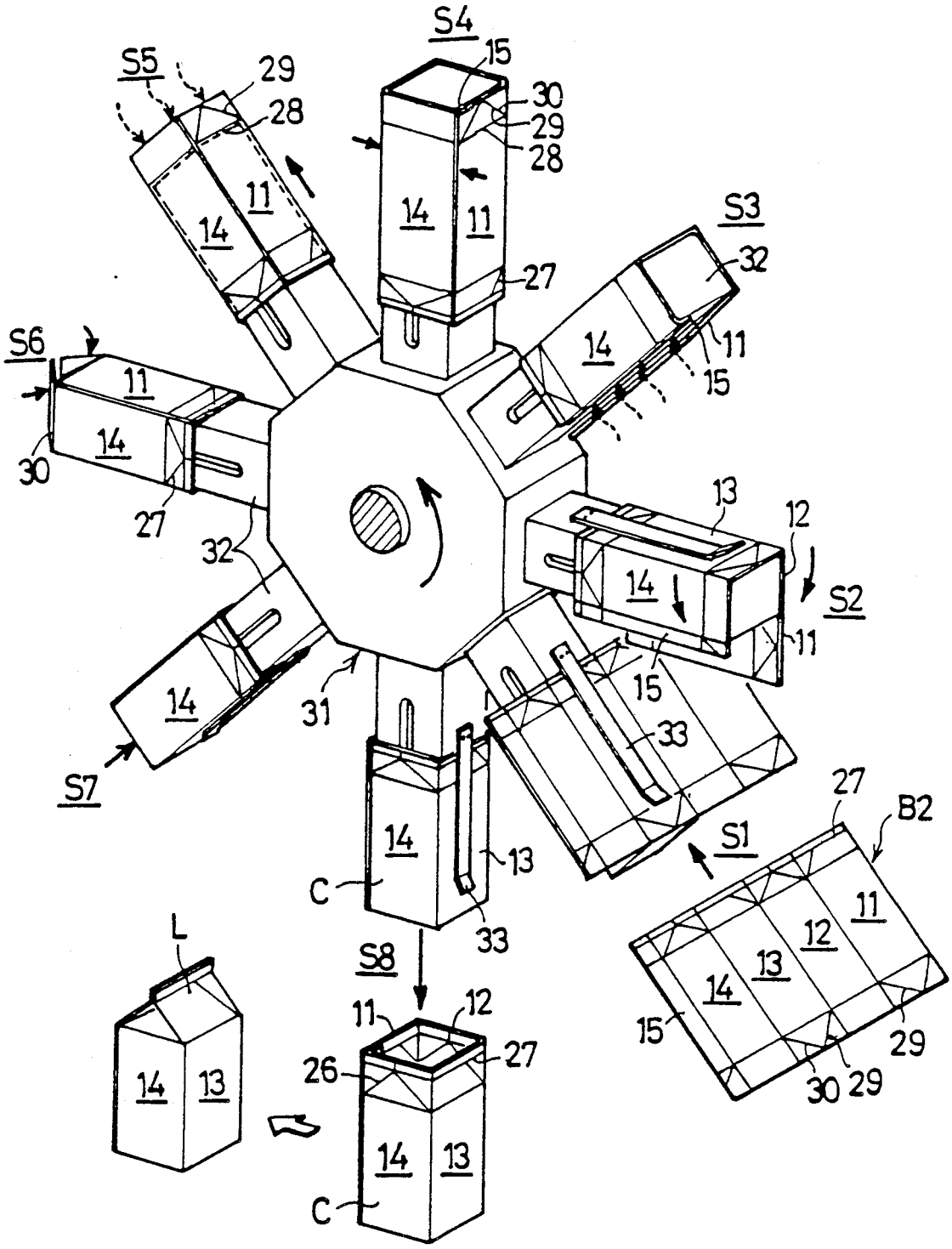

The process described above for forming the container from the first blank B1 is generally shown in FIG. 6. FIG. 7 shows a process for forming the second blank B2 into a container although this process will not be described.

The container C prepared from the first blank B1 is transferred as it is from the mandrel 32 to the conveyor, whereas the container C prepared from the second blank B2 is so transferred preferably as rotated through 90 degrees about its own axis for the following reason. When the top portion of the container is to be folded in the form of a gabled roof during transport on the conveyor, the pair of opposed quadrilateral parts of the top portion having the inverted V-scores 26 is folded first before the other pair of like parts. The container C is rotated as above to position the former pair along the direction of movement of the conveyor.

The desired product is filled into the transferred container, and the top portion of the container is folded in the form of a gabled roof and closed, while the container is being transported by the conveyor.

SECOND EMBODIMENT

FIGS. 10 to 17 show a second embodiment.

Figure 16:
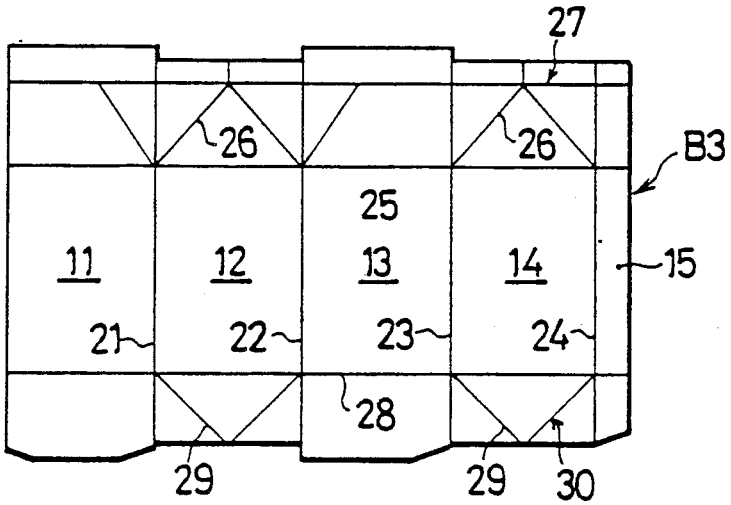
Figure 17:
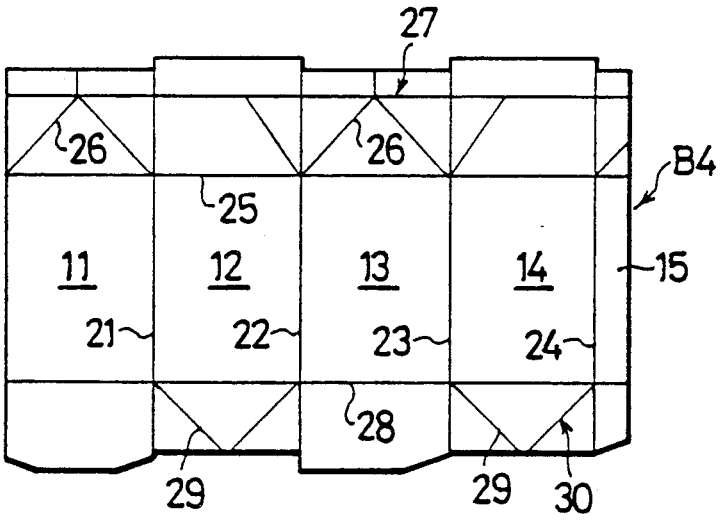

Third blanks B3 and fourth blanks B4 as shown in FIGS. 16 and 17, respectively, are used for the second embodiment.

With reference to FIG. 16, the third blank B3 corresponds to the first blank wherein the fifth panel 15 at the left end is positioned at the right end, comprises first to fifth panels 11 to 15 extending continuously as arranged one after another from the left rightward, and has the same score pattern as the first blank B1.

With reference to FIG. 17, the fourth blank B4 corresponds to the second blank wherein the fifth panel 15 at the left end is positioned at the right end, comprises first to fifth panels 11 to 15 extending continuously as arranged one after another from the left rightward, and has the same score pattern as the second blank B2.

Figure 10:
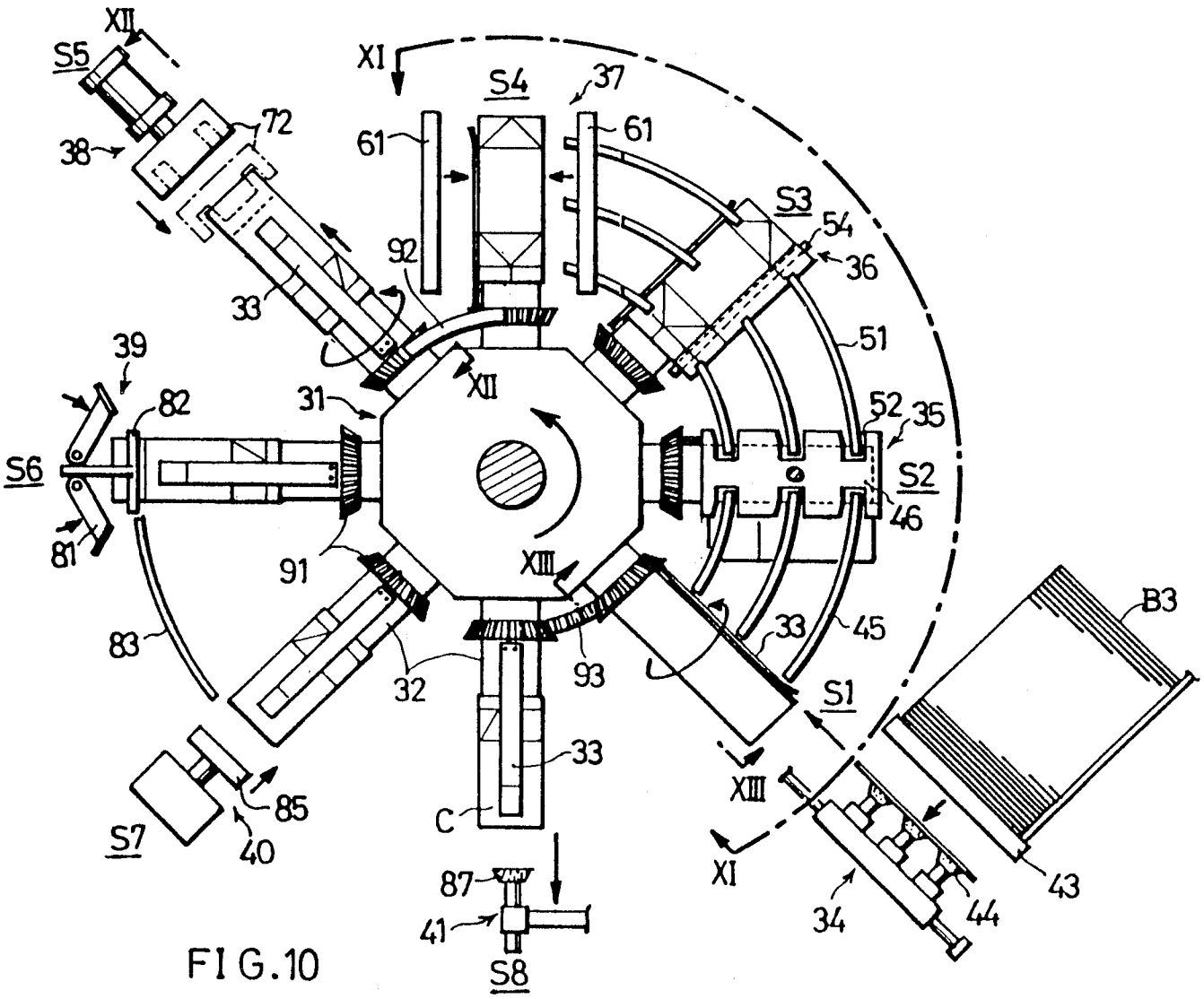
FIGS. 10 to 17 show a second embodiment.
Figure 11:
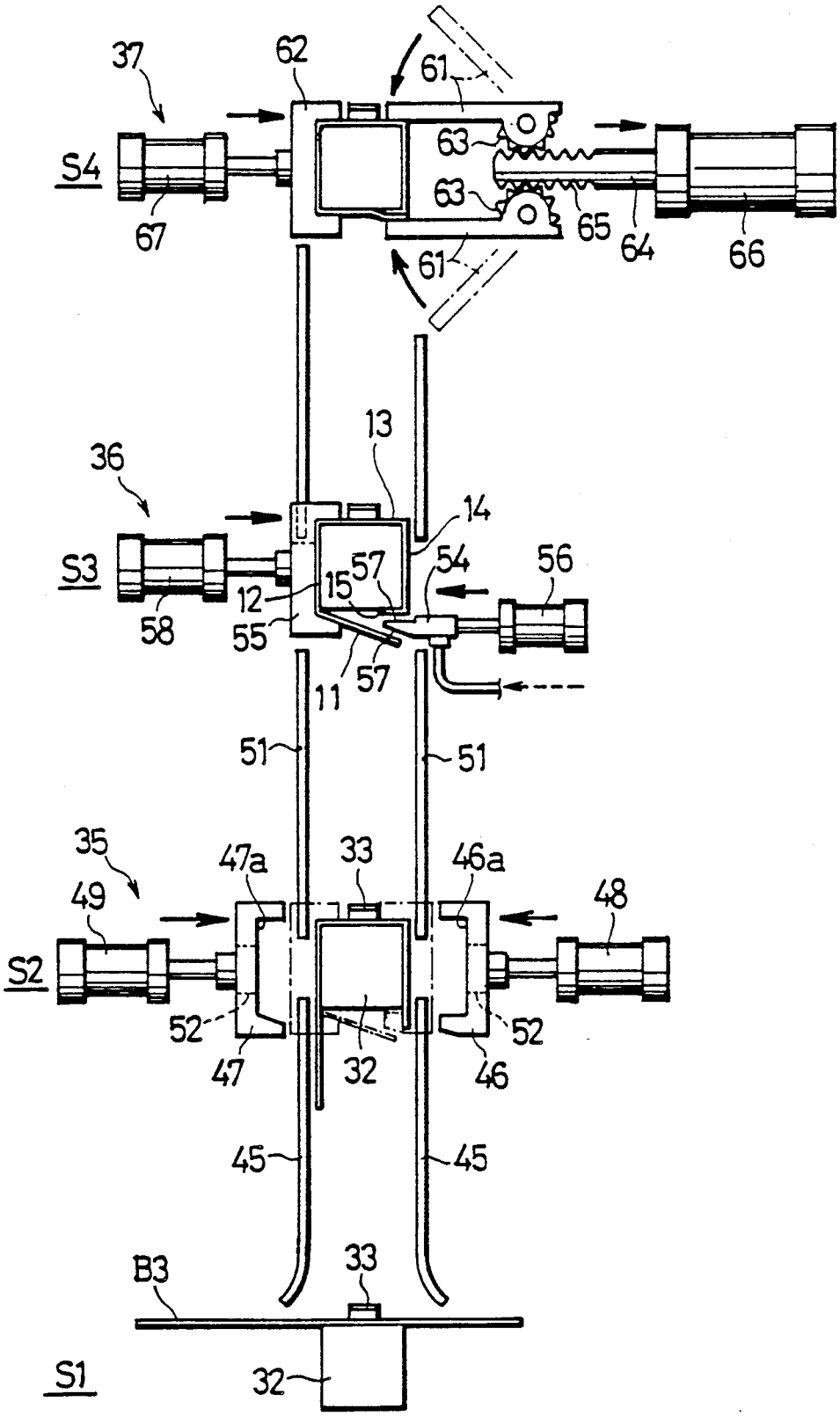
Figure 12:
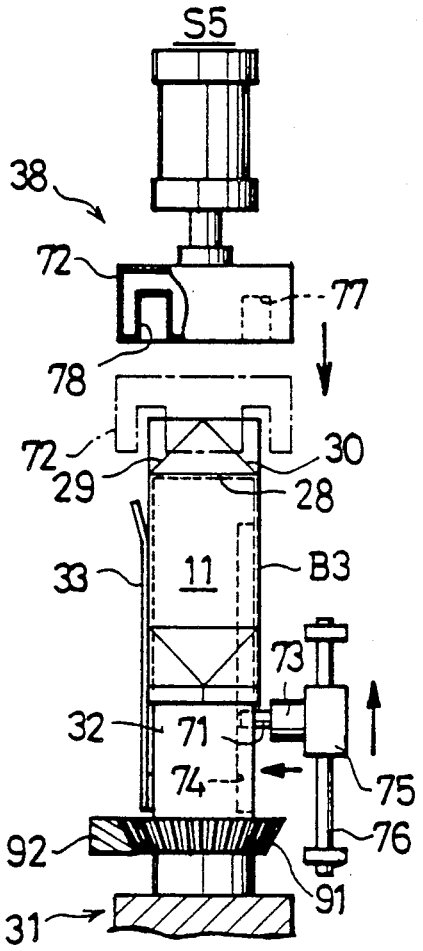
Figure 13:
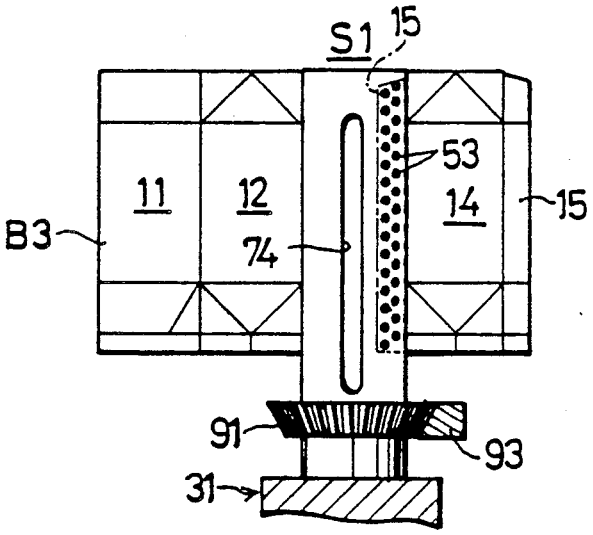

FIG. 10 shows the container forming apparatus of the second embodiment, which like the first embodiment, comprises a horizontal rotary body 31, mandrels 32, blank holders 33, blank feeder 34, blank folder 35, seam heater 36, seam sealer 37, bottom heater 38, bottom breaker 39, bottom sealer 40 and container transfer device 41.

The features of the second embodiment as distinct from the first embodiment only will be described below. Throughout the drawings showing the two embodiments, like parts are designated by like reference numerals and will not be described again. Third blanks B3 are chiefly used for the second embodiment.

Each mandrel 32 attached to the rotary body 31 is rotatable about its own axis and is provided at its base portion with an inward bevel gear 91. A circular-arc rack 92 facing rightward extends from the fourth treating station S4 to the fifth treating station S5 at the left side of the path of movement of the bevel gear 91. A circular-arc rack 93 facing leftward extends from the eighth treating station S8 to the first treating station S1 at the right side of the path. These racks 92 and 93 are meshable with the bevel gears 91 on the mandrels 32.

While the mandrel 32 moves from the fourth station S4 to the fifth station S5, the bevel gear 91 meshes with the rightward rack.92 to rotate the mandrel 32 through 90 degrees counterclockwise as it is seen from its outer end toward the inner end thereof. While the mandrel 32 moves from the eighth station S8 to the first station S1, the bevel gear 91 meshes with the leftward rack 93, thereby rotating the mandrel 32 clockwise as the mandrel is seen from its outer end toward the inner end thereof.

The second embodiment is oriented in opposite relation to the first embodiment transversely of the path of movement of the mandrel 32 with respect to the direction of the two folding members 46, 47 of the blank folder 35, the direction of the nozzle 54 and the holding member 55 of the seam heater 36, the direction of the clamp members 61 and the holding member 62 of the seam sealer 37, and the direction of the pushing-out member 71 of the bottom heater 38.

The mandrel 32 is rotated before reaching the fifth station S5 in order to orient the blank B3 in the same direction as the blank B1 in the first embodiment. With the first embodiment, the first panel 11 and the third panel 13 (each having the V-score 29 at the bottom portion) face toward the direction of movement of the mandrel 32. With the second embodiment, the second panel 12 and the fourth panel 14 (similarly each having the V-score 29) face toward a direction perpendicular to the path of movement until the mandrel reaches the fourth station S4, are then rotated through 90 degrees and thereby caused to face toward the direction of movement of the mandrel 32.

Figure 14:
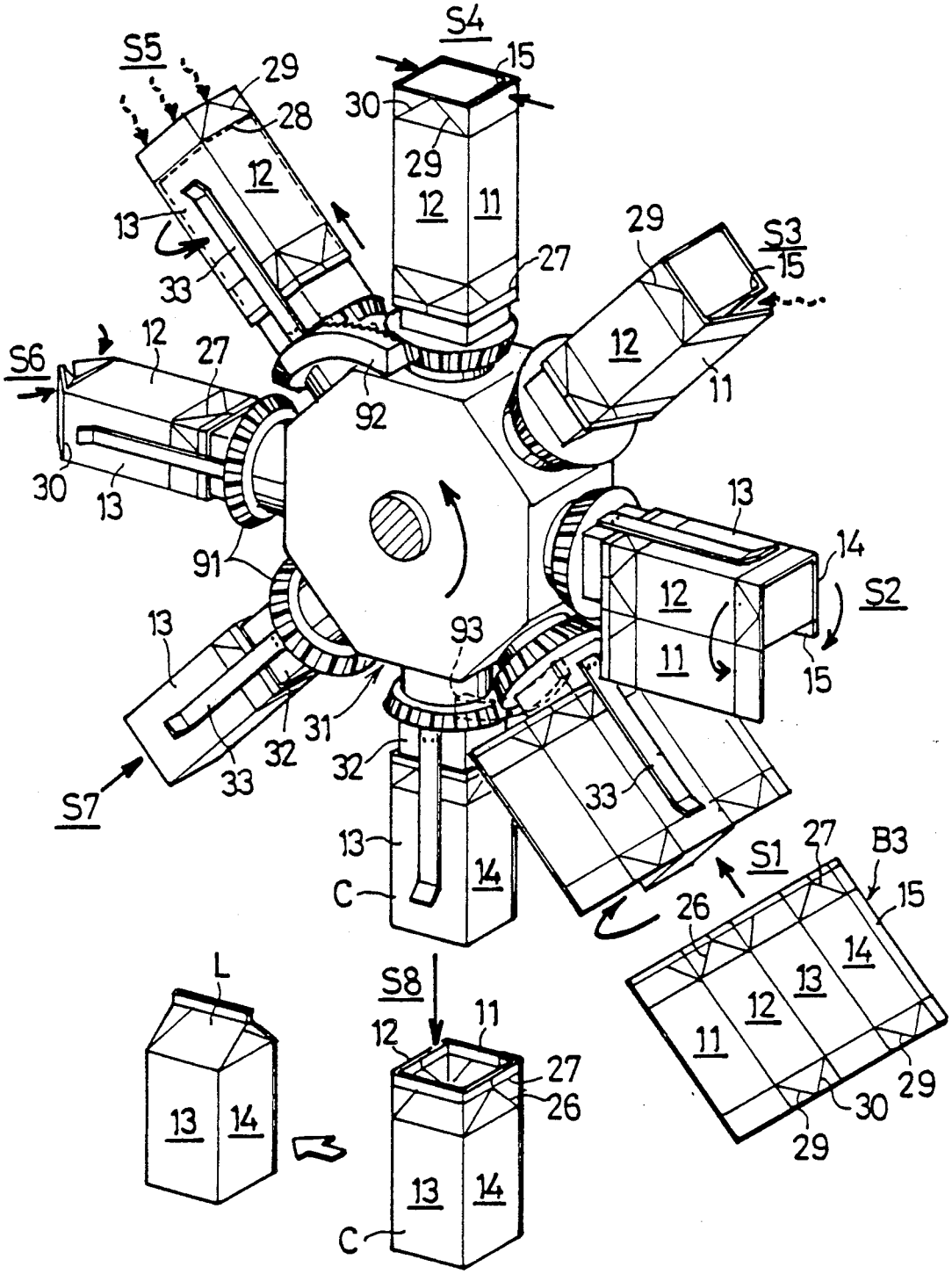
Figure 15:
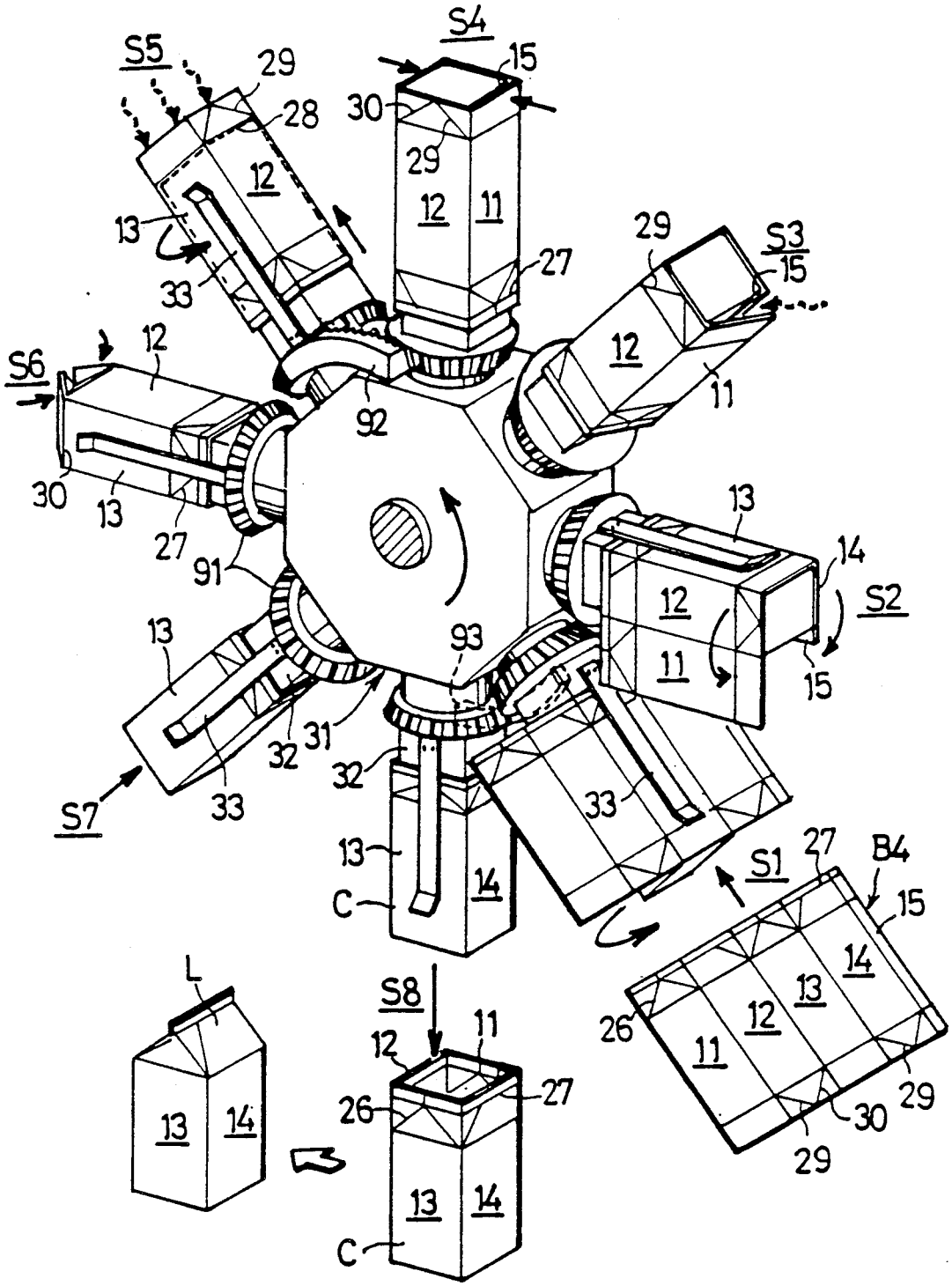

As in the case of the first embodiment, FIG. 14 shows the process for forming the third blank B3 into a container, and FIG. 15 shows the process for forming the fourth blank B4 into a container. The container C prepared from the third blank B3 is transferred as it is from the mandrel 32 to the container conveyor, whereas it is desirable that the container C prepared from the fourth blank B4 be transferred as rotated through 90 degrees for the same reason as in the case of the first embodiment.

What is claimed is:

1. An apparatus for forming tubular containers having a square to rectangular cross section and a bottom from planar heat-sealable sheets comprising:

an apparatus frame having a plurality of treating stations including a planar sheet feed station, a rotary body having radial mandrels and intermittently drivingly rotatable so as to stop each of the mandrels at the plurality of treating stations successively, holding means provided on each of the mandrels for holding the planar sheet to the mandrel, a feeder for feeding the planar sheet to the holding means at the planar sheet feed station, and a series of means including tube-forming folding means and bottom-forming closing means, said series of means arranged one after another along the path of movement of the mandrels extending from the planar sheet feed station, the tube-forming folding means for folding the planar sheet held by the holding means around the mandrel into a tube and the bottom-forming closing means for closing one end of the sheet folded around the mandrel to provide the bottom and form the container such that the planar sheet is wrapped around the mandrel by said tube-forming folding means at a location along the path of movement of the mandrels between the planar sheet feed station and said bottom-forming closing means.

2. An apparatus as defined in claim 1 wherein each of the mandrels has four side faces in conformity with the inner surfaces of the four side walls of the container as formed, and the holding means comprises a planar sheet holder made of a striplike plate spring, the planar sheet holder being fitted over one of the four side faces of the mandrel facing toward the direction of movement of the mandrel, the planar sheet holder extending longitudinally of the mandrel and being fixed at its one end to the base portion of said one side face of the mandrel.

3. An apparatus as defined in claim 2 wherein the feeder comprises a magazine disposed obliquely above and at a specified distance from an extension of the axis of the mandrel stopped at the feed station for containing a multiplicity of planar sheets as stacked up, and a suction member movable in directions parallel and perpendicular to the extension of the axis of the mandrel for withdrawing the planar sheets one by one and feeding the planar sheet to the mandrel stopped at the feed station so that the planar sheet is held between the mandrel and the planar sheet holder.

4. An apparatus as defined in claim 1 wherein the tube-forming folding means include a folder for folding the required portions of the planar sheet held by the holding means to fit the sheet around the mandrel so that the opposed edge portions of the sheet to be made into a seam thereof can be joined together under pressure, a seam heater for heating the opposed edge portions of the sheet as fitted around the mandrel, a seam sealer for joining the heated edge portions together under pressure to form the tubular blank, and wherein said bottom-forming closing means comprises a bottom heater for heating said one end of the tubular blank to be made into the container bottom, a bottom breaker for folding the heated end flat, and a bottom sealer for pressing the folded end to form the container.

5. An apparatus as defined in claim 4 wherein the folder comprises at least one pair of folding rails opposed to each other at opposite sides of the path of movement and extending along the path from a first of the treating stations being a feed station, to a second treating station, wherein two folding members movable toward or away from each other are arranged at opposite sides of the mandrel when the mandrel is stopped at the second treating station with the mandrel positioned therebetween.

6. An apparatus as defined in claim 4 wherein the seam heater comprises a nozzle disposed at a third treating station next to the second treating station for applying hot air to the edge portions of the blank to be made into the seam, and a holding member for holding the blank to the mandrel before the application of hot air to prevent the blank from shifting relative to the mandrel during the application.

7. An apparatus as defined in claim 4 wherein the seam sealer comprises a pair of clamp members for clamping the blank as fitted around the mandrel when the mandrel is stopped at a fourth treating station next to the third treating station, and a holding member for holding the blank to the mandrel before clamping to prevent displacement of the blank from the mandrel during the clamping.

8. An apparatus as defined in claim 4 wherein the bottom heater comprises a pushing-out member for pushing out the bottom providing end of the tubular blank beyond the mandrel as the blank is fitted around the mandrel when the mandrel is stopped at a fifth treating station next to the fourth treating station, and a hot air blowing head moveable toward or away from said blank end for applying hot air to the portion of said end to be heated.

9. An apparatus as defined in claim 1 wherein each of the mandrels has an axis and is rotatable about its own axis, the apparatus further comprising means for rotating each mandrel forward through 90 degrees and reversely through 90 degrees while the rotary body makes one turn of rotation.

10. An apparatus as defined in claim 1, wherein said tube-forming folding means comprise a stationary folding means for folding the planar sheet around the mandrel as the mandrel rotates past the folding means.

11. An apparatus as defined in claim 1, wherein said feeder feeds the planar sheet to be held by the holding means on the mandrel in a position where the plane of the planar sheet is substantially perpendicular to the plane of rotation of the mandrel through the plurality of treating stations.

* * * * *